US011584977B2

(12) United States Patent
Yan et al.

(10) Patent No.: US 11,584,977 B2
(45) Date of Patent: Feb. 21, 2023

(54) 3XX ALUMINUM CASTING ALLOYS, AND METHODS FOR MAKING THE SAME

(71) Applicant: ALCOA USA CORP., Pittsburgh, PA (US)

(72) Inventors: Xinyan Yan, Murrysville, PA (US); Jen C. Lin, Export, PA (US)

(73) Assignee: ALCOA USA CORP., Pittsburgh, PA (US)

( * ) Notice: Subject to any disclaimer, the term of this patent is extended or adjusted under 35 U.S.C. 154(b) by 328 days.

(21) Appl. No.: 15/895,497

(22) Filed: Feb. 13, 2018

(65) Prior Publication Data

US 2018/0171438 A1 Jun. 21, 2018

Related U.S. Application Data

(63) Continuation of application No. PCT/US2016/046613, filed on Aug. 11, 2016.

(60) Provisional application No. 62/204,762, filed on Aug. 13, 2015.

(51) Int. Cl.

| | |
|---|---|
| ***C22C 21/04*** | (2006.01) |
| ***C22F 1/043*** | (2006.01) |
| ***B22D 21/04*** | (2006.01) |
| ***B22D 21/00*** | (2006.01) |
| ***C22C 21/02*** | (2006.01) |

(52) U.S. Cl.

CPC ..... *C22C 21/04* (2013.01); *B22D 21/00* (2013.01); *B22D 21/04* (2013.01); *C22C 21/02* (2013.01); *C22F 1/043* (2013.01)

(58) Field of Classification Search

CPC ..... C22C 21/04; C22F 1/043

See application file for complete search history.

(56) References Cited

U.S. PATENT DOCUMENTS

| | | | |
|---|---|---|---|
| 1,508,556 | A | 9/1924 | Jeffries et al. |
| 1,799,837 | A | 4/1931 | Archer et al. |
| 1,924,726 | A | 8/1933 | Rowe |
| 1,947,121 | A | 2/1934 | Bonsack |
| 2,525,130 | A | 10/1950 | Hall et al. |
| 2,821,495 | A | 1/1958 | Dulin |
| 3,128,176 | A | 4/1964 | Martin |
| 3,726,672 | A | 4/1973 | Lindberg et al. |

(Continued)

FOREIGN PATENT DOCUMENTS

| | | | |
|---|---|---|---|
| CN | 103276258 | A | 9/2013 |
| DE | 102009012073 | A1 | 9/2010 |

(Continued)

OTHER PUBLICATIONS

ASM Handbook vol. 15: Casting, ASM International, p. 1009-1018. DOI: 10.31399/asm.hb.b15.a0005287. (Year: 2008).*

(Continued)

*Primary Examiner* — George Wyszomierski
*Assistant Examiner* — Janell C Morillo
(74) *Attorney, Agent, or Firm* — Greenberg Traurig, LLP

(57) ABSTRACT

New 3xx aluminum casting alloys are disclosed. The aluminum casting alloys generally include from 6.5 to 11.0 wt. % Si, from 0.20 to 0.80 wt. % Mg, from 0.05 to 0.50 wt. % Cu, from 0.10 to 0.80 wt. % Mn, from 0.005 to 0.05 wt. % Sr, up to 0.25 wt. % Ti, up to 0.30 wt. % Fe, and up to 0.20 wt. % Zn, the balance being aluminum and impurities.

20 Claims, 9 Drawing Sheets

(56) References Cited

U.S. PATENT DOCUMENTS

| | | | | |
|---|---|---|---|---|
| 3,881,879 | A | 5/1975 | Singleton, Jr. et al. | |
| 4,104,089 | A | 8/1978 | Miki | |
| 4,336,076 | A | 6/1982 | Edamura et al. | |
| 4,636,356 | A | 1/1987 | Iwasaki et al. | |
| 4,808,374 | A | 2/1989 | Awano et al. | |
| 4,929,511 | A | 5/1990 | Bye, Jr. et al. | |
| 5,009,844 | A | 4/1991 | Laxmanan | |
| 5,234,759 | A | 8/1993 | Inabayashi et al. | |
| 5,837,070 | A | 11/1998 | Sainfort et al. | |
| 5,837,388 | A | 11/1998 | Doko et al. | |
| 6,200,396 | B1 | 3/2001 | Laslaz et al. | |
| 6,267,829 | B1 | 7/2001 | Backerud et al. | |
| 6,355,213 | B1 | 3/2002 | Takasaki et al. | |
| 6,364,970 | B1 | 4/2002 | Hielscher et al. | |
| 6,511,555 | B2 | 1/2003 | Feikus et al. | |
| 6,773,666 | B2 * | 8/2004 | Lin | B22D 17/00 420/544 |
| 6,923,935 | B1 | 8/2005 | Donahue et al. | |
| 7,087,125 | B2 | 8/2006 | Lin et al. | |
| 7,625,454 | B2 * | 12/2009 | Lin | C22C 1/005 148/417 |
| 7,666,353 | B2 * | 2/2010 | Donahue | C22C 21/02 420/548 |
| 7,695,577 | B2 | 4/2010 | Shioda et al. | |
| 7,892,482 | B2 | 2/2011 | Bischofberger et al. | |
| 8,349,462 | B2 | 1/2013 | Lin et al. | |
| 8,480,822 | B2 | 7/2013 | Kohlmann | |
| 2002/0155023 | A1 | 10/2002 | Barresi et al. | |
| 2004/0045638 | A1 * | 3/2004 | Garat | C22C 21/02 148/417 |
| 2005/0161128 | A1 | 7/2005 | DasGupta | |
| 2006/0011321 | A1 | 1/2006 | Koch | |
| 2009/0297393 | A1 * | 12/2009 | Wust | C22F 1/043 420/544 |
| 2014/0140886 | A1 | 5/2014 | Speckert et al. | |
| 2016/0355908 | A1 * | 12/2016 | Yoshida | C22C 21/02 |

FOREIGN PATENT DOCUMENTS

| | | | |
|---|---|---|---|
| EP | 1331281 | | 7/2003 |
| EP | 2471966 | A1 | 7/2012 |
| GB | 1529305 | | 10/1978 |
| JP | S58-42748 | | 3/1983 |
| JP | H01-319646 | | 12/1989 |
| JP | H04-168241 | | 6/1992 |
| JP | 2003-027169 | A | 1/2003 |
| WO | WO96/27686 | | 9/1996 |
| WO | WO2005-071127 | | 8/2005 |

OTHER PUBLICATIONS

International Search Report and Written Opinion, dated Nov. 17, 2016, from corresponding, co-owned International Patent App. No. PCT/US2016/046613.

ASM Handbook, 9$^{th}$ Edition, Metals Handbook, vol. 15, "Casting", ASM International, pp. 746, 751, 752, 1988.

"Primary Aluminium Casting Alloys", by Aluminium Rheinfelden GmbH, Rheinfelden, Germany, sales brochure, 2006.

Registration Record Pink Sheets, Designations and Chemical Composition Limits for Aluminum Alloys in the Form of Castings and Ingot, pp. 1-12, Nov. 2009.

* cited by examiner

FIG. 1 - Embodiments of the new 3xx aluminum casting alloy

(all values in weight percent)

| Embod-iment | Si | Mg | Cu | Mn | Sr | Ti | Fe | Zn | Imp., each | Imp., total | Bal |
|---|---|---|---|---|---|---|---|---|---|---|---|
| 1 | 6.5 - 11.0 | 0.20 - 0.80 | 0.05 - 0.50 | 0.10 - 0.80 | 0.005 - 0.050 | ≤0.25 | ≤0.30 | ≤0.20 | ≤0.10 | ≤0.35 | Al |
| 2 | 7.0 - 10.75 | 0.20 - 0.80 | 0.05 - 0.50 | 0.10 - 0.80 | 0.005 - 0.050 | ≤0.25 | ≤0.30 | ≤0.20 | ≤0.10 | ≤0.35 | Al |
| 3 | 7.25 - 10.5 | 0.20 - 0.80 | 0.05 - 0.50 | 0.10 - 0.80 | 0.005 - 0.050 | ≤0.25 | ≤0.25 | ≤0.15 | ≤0.10 | ≤0.35 | Al |
| 4 | 7.5 - 10.25 | 0.20 - 0.80 | 0.05 - 0.50 | 0.10 - 0.80 | 0.005 - 0.050 | ≤0.25 | ≤0.25 | ≤0.15 | ≤0.10 | ≤0.35 | Al |
| 5 | 7.75 - 10.0 | 0.20 - 0.80 | 0.05 - 0.50 | 0.10 - 0.80 | 0.005 - 0.050 | ≤0.25 | ≤0.20 | ≤0.15 | ≤0.10 | ≤0.35 | Al |
| 6 | 8.0 - 10.0 | 0.20 - 0.80 | 0.05 - 0.50 | 0.10 - 0.80 | 0.005 - 0.050 | ≤0.25 | ≤0.15 | ≤0.10 | ≤0.10 | ≤0.35 | Al |
| 7 | 8.25 - 9.75 | 0.30 - 0.75 | 0.075 - 0.45 | 0.15 - 0.70 | 0.008 - 0.040 | ≤0.25 | 0.01 - 0.15 | ≤0.10 | ≤0.05 | ≤0.15 | Al |
| 8 | 8.40 - 9.50 | 0.40 - 0.725 | 0.10 - 0.40 | 0.20 - 0.60 | 0.010 - 0.030 | ≤0.25 | 0.01 - 0.13 | ≤0.10 | ≤0.05 | ≤0.15 | Al |
| 9 | 8.40 - 9.25 | 0.40 - 0.70 | 0.125 - 0.35 | 0.25 - 0.55 | 0.012 - 0.025 | ≤0.25 | 0.01 - 0.12 | ≤0.07 | ≤0.04 | ≤0.12 | Al |
| 10 | 8.50 - 9.00 | 0.50 - 0.675 | 0.15 - 0.30 | 0.30 - 0.50 | 0.014 - 0.022 | ≤0.25 | 0.01 - 0.11 | ≤0.07 | ≤0.03 | ≤0.10 | Al |
| 11 | 8.60 - 8.90 | 0.60 - 0.65 | 0.18 - 0.25 | 0.35 - 0.45 | 0.016 - 0.020 | ≤0.25 | 0.01 - 0.11 | ≤0.05 | ≤0.03 | ≤0.10 | Al |

FIG. 2 - Depth of attack in ASTM G110 test

| G110 Test Duration | Alloy | Test Surface | Site 1 | Site 2 | Site 3 | Site 4 | Site 5 | Maximum | Average |
|---|---|---|---|---|---|---|---|---|---|
| 6 hours | A1 (0% Cu) | As-Cast | 102.8 | 28.7 | -- | -- | -- | 102.8 | 65.8 |
| | | Machined | 12.7 | -- | -- | -- | -- | 12.7 | 12.7 |
| | A2 (0.20% Cu) | As-Cast | 309.5 | 109.7 | 130.7 | 202.7 | 167.2 | 309.5 | 184.0 |
| | | Machined | 142.0 | 158.0 | 217.2 | 147.4 | 178.0 | 217.2 | 168.5 |
| | A3 (0.51% Cu) | As-Cast | 361.4 | 414.7 | 138.9 | 120.0 | 257.4 | 414.7 | 258.5 |
| | | Machined | 275.4 | 308.2 | 175.4 | 280.1 | 195.4 | 308.2 | 246.9 |
| 24 hours | A1 (0% Cu) | As-Cast | 64.7 | 16.7 | -- | -- | -- | 64.7 | 40.7 |
| | | Machined | 79.4 | 23.3 | -- | -- | -- | 79.4 | 51.4 |
| | A2 (0.20% Cu) | As-Cast | 215.4 | 219.4 | 381.4 | 358.0 | 422.9 | 422.9 | 319.4 |
| | | Machined | 320.9 | 326.0 | 395.2 | 288.4 | 196.0 | 395.2 | 305.3 |
| | A3 (0.51% Cu) | As-Cast | 278.7 | 464.7 | 438.7 | 415.4 | 583.4 | 583.4 | 436.2 |
| | | Machined | 312.7 | 500.1 | 354.7 | 426.2 | 582.9 | 582.9 | 435.3 |

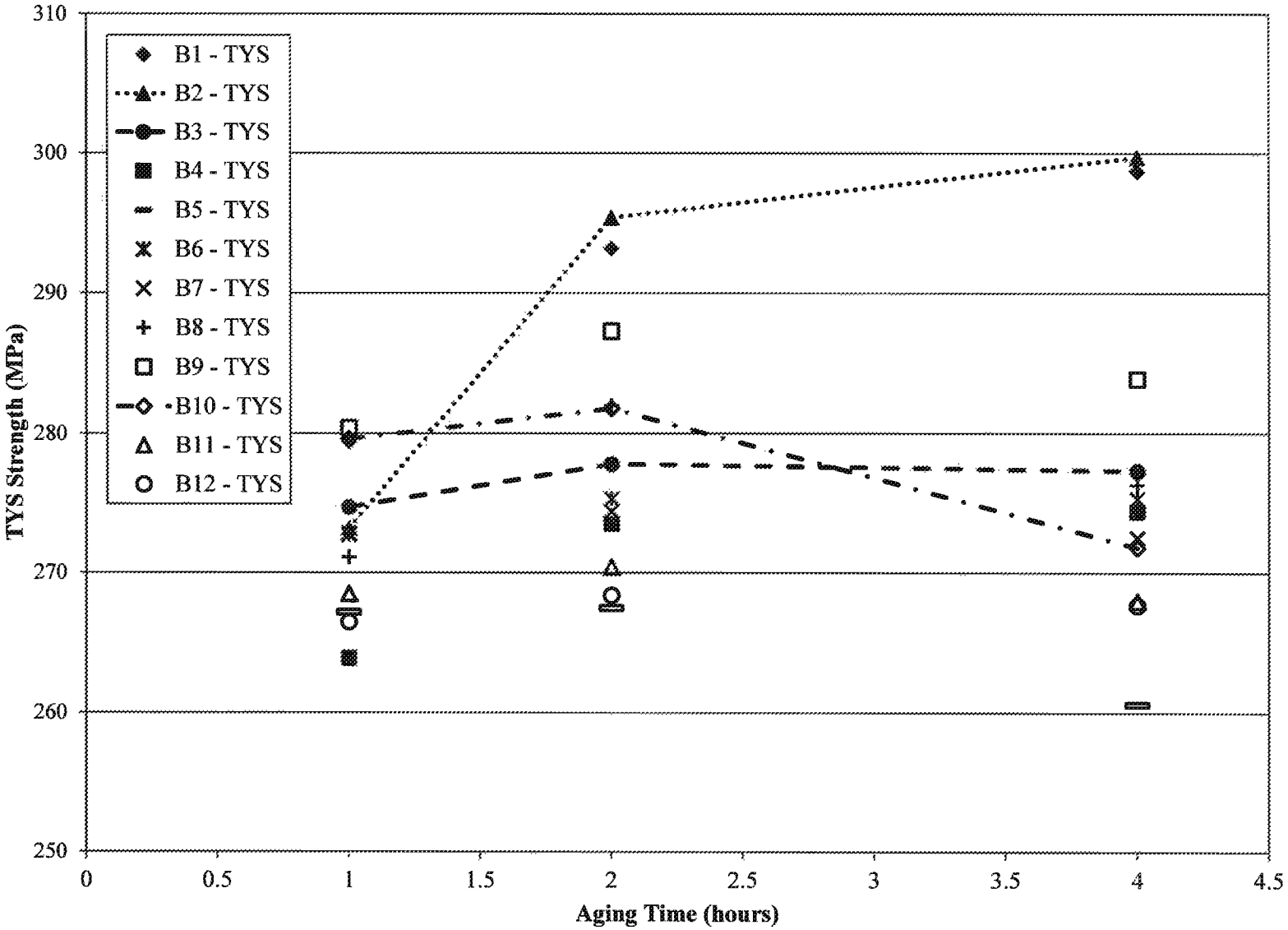
FIG. 3a - Example 2 Alloys - Tensile Strength Properties

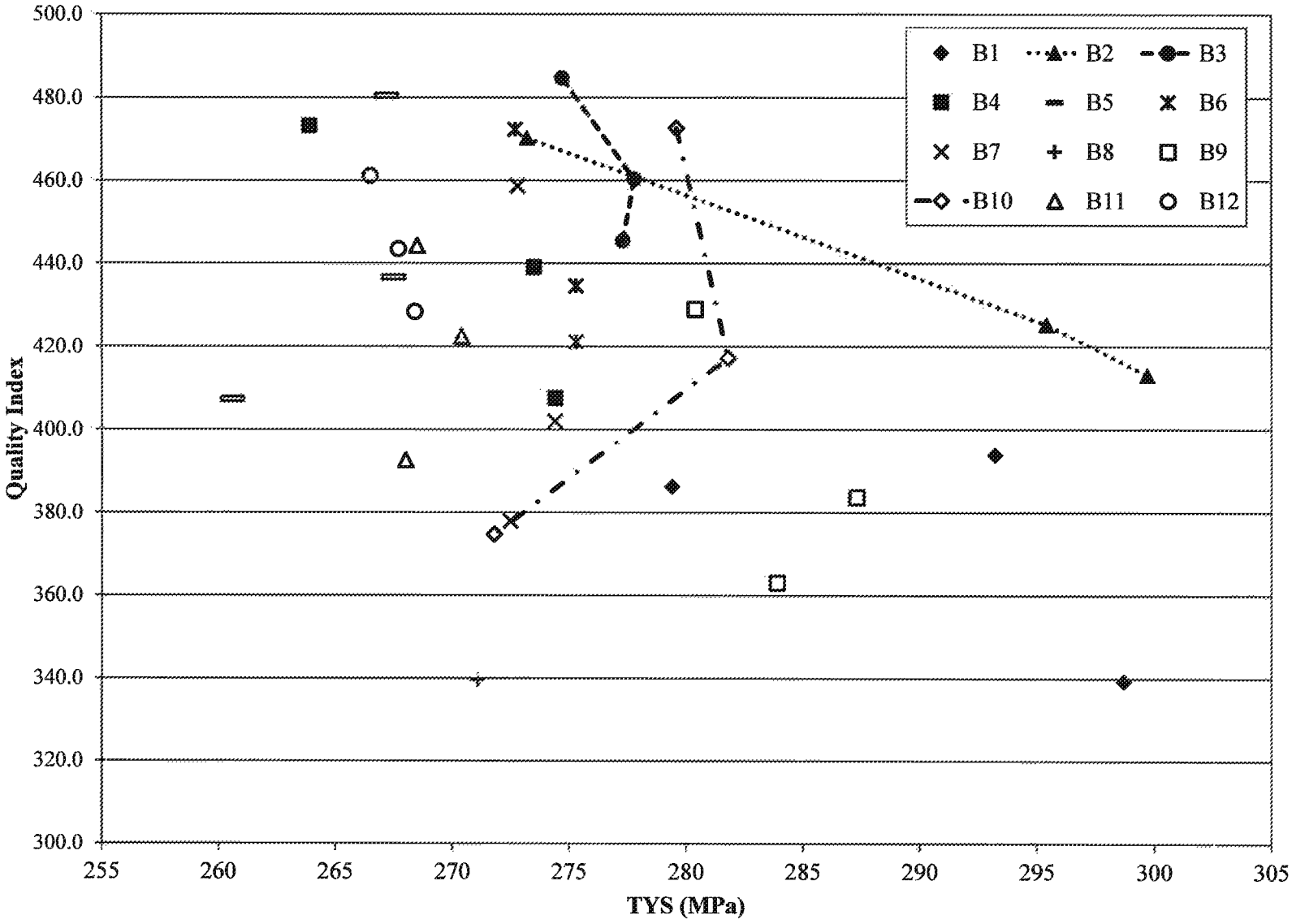
FIG. 3b - Example 2 Alloys - TYS v. Quality Index

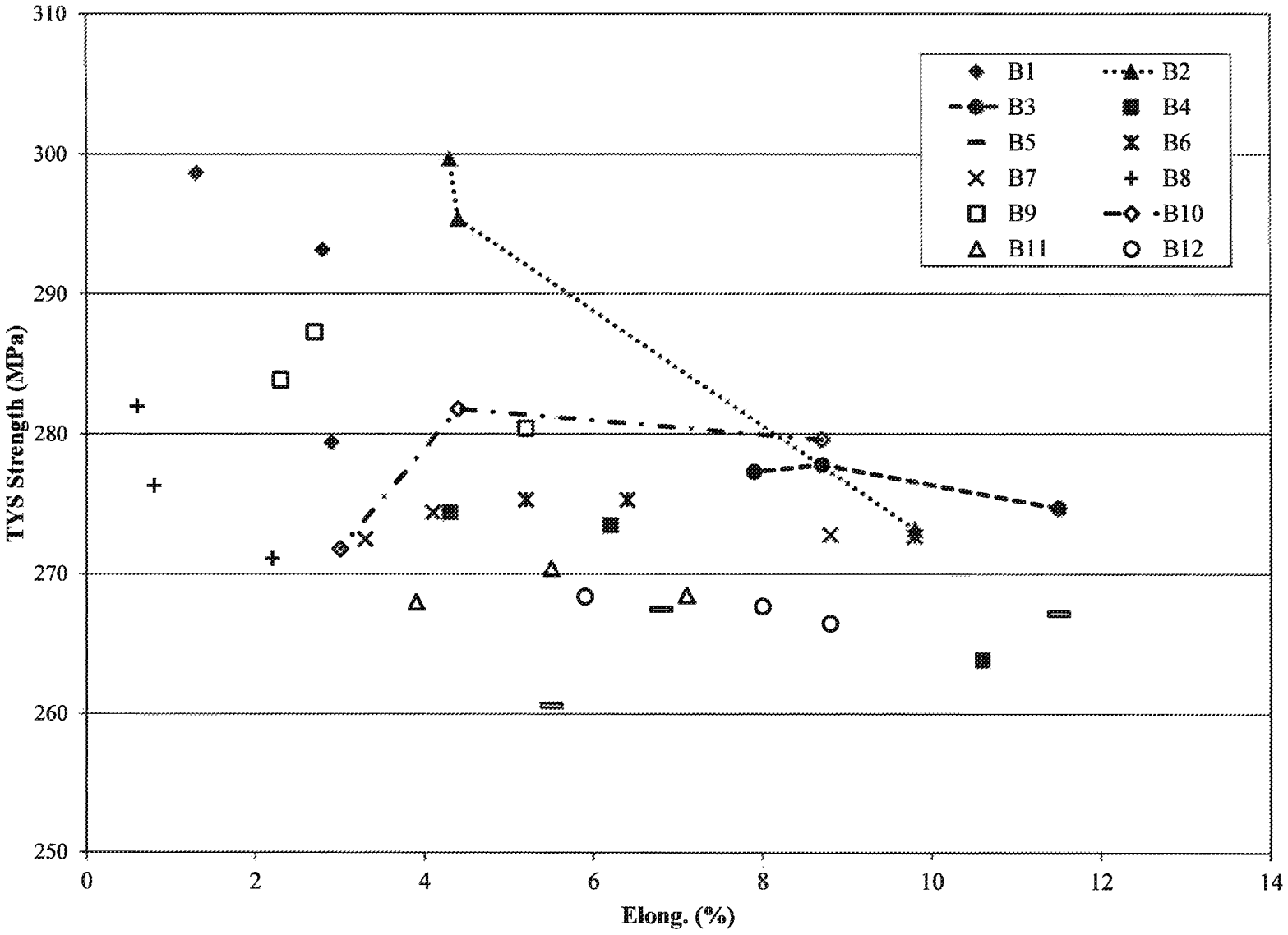
FIG. 3c - Example 2 Alloys - Elong. v. TYS

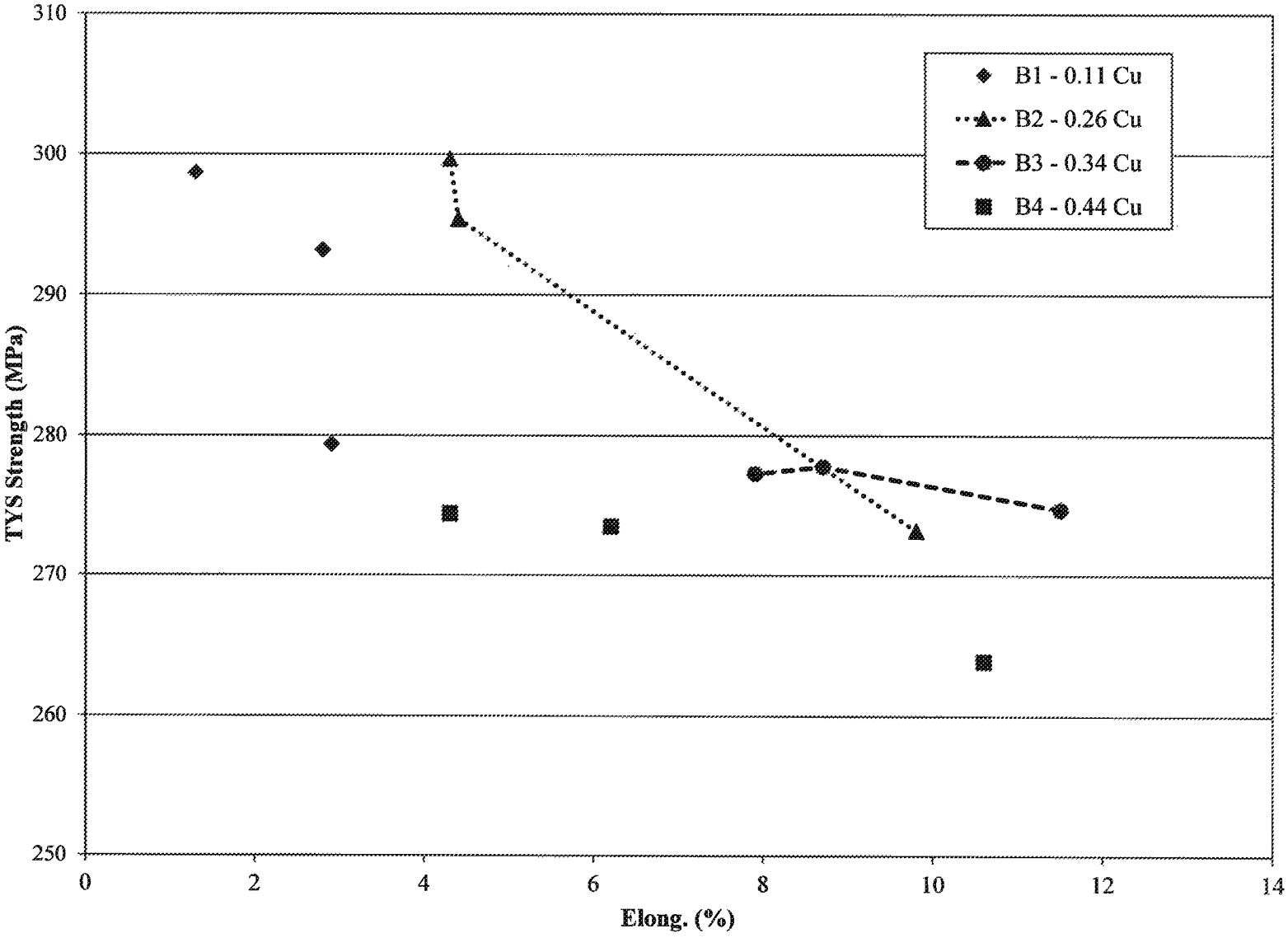
FIG. 4a - Example 2 Alloys - Elong v. TYS

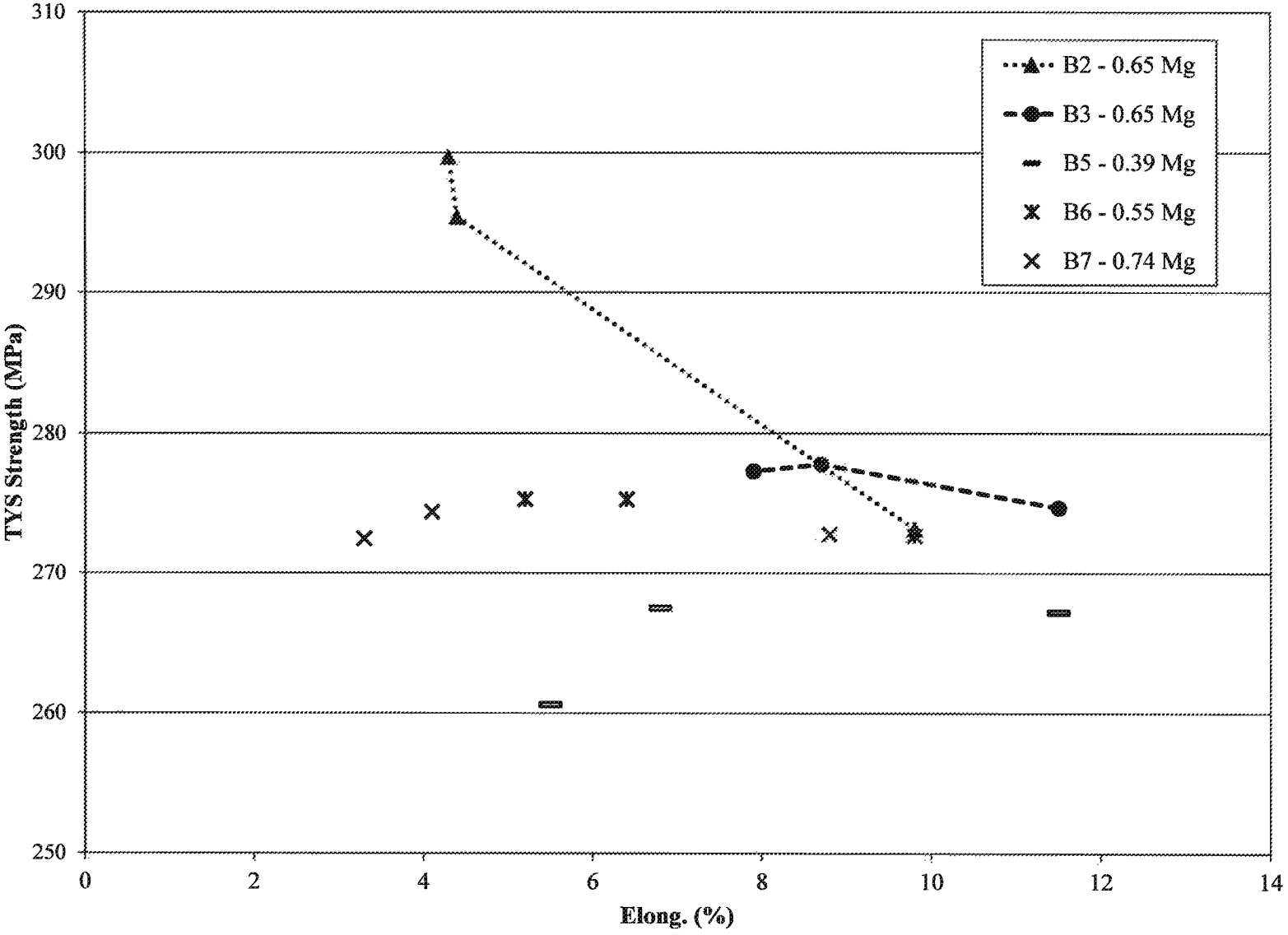
FIG. 4b - Example 2 Alloys - Elong. v. TYS

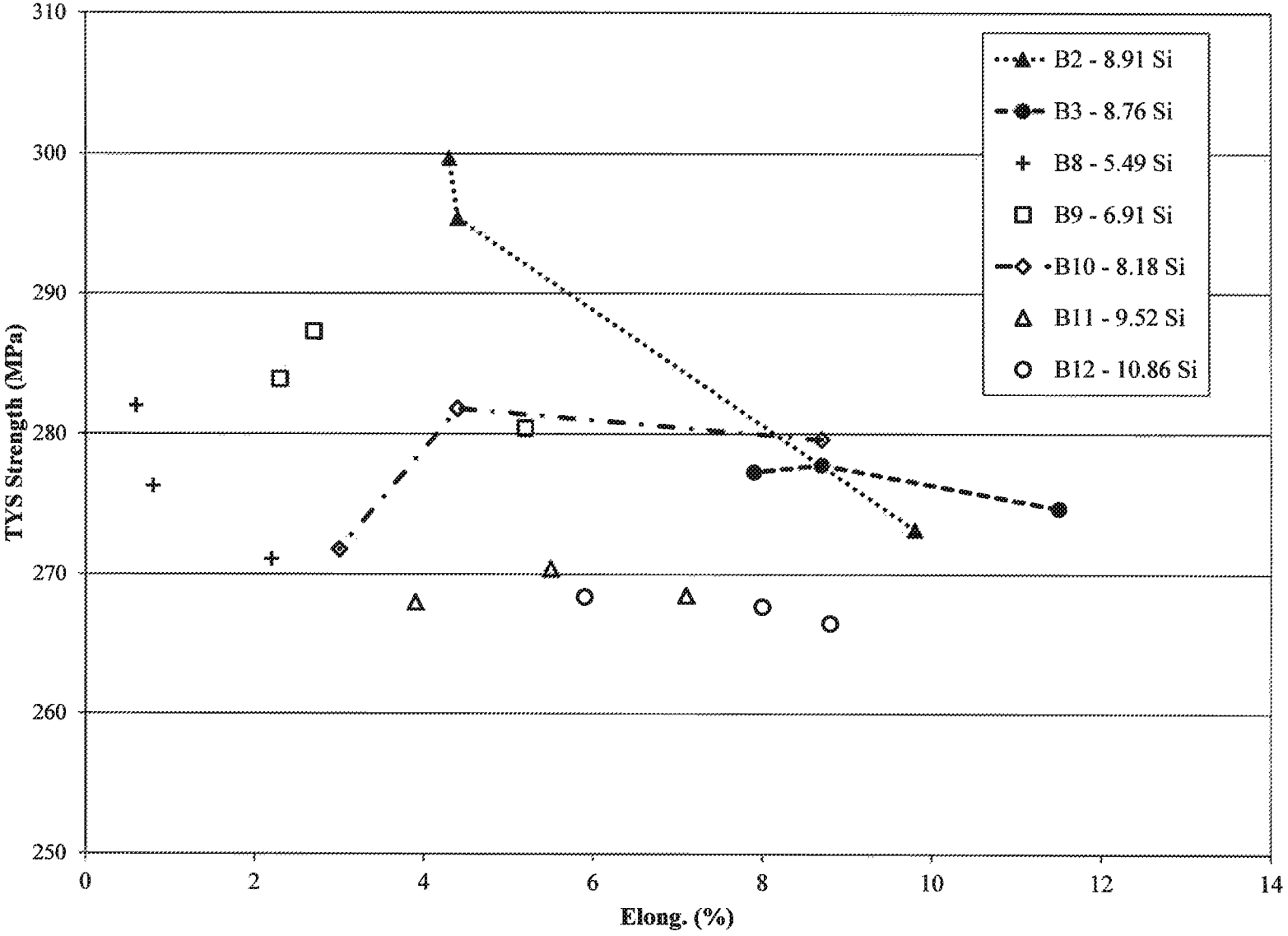
FIG. 4c - Example 2 Alloys - Elong. v. TYS

3XX ALUMINUM CASTING ALLOYS, AND METHODS FOR MAKING THE SAME

CROSS-REFERENCE TO RELATED APPLICATION

This application is a continuation of International Patent Application No. PCT/US2016/046613, filed Aug. 11, 2016, which claims the benefit of priority of U.S. Provisional Patent Application No. 62/204,762, filed Aug. 13, 2015, both entitled "IMPROVED 3XX ALUMINUM CASTING ALLOYS, AND METHODS FOR MAKING THE SAME" each of which is incorporated herein by reference in its entirety.

BACKGROUND

Aluminum alloys are useful in a variety of applications. However, improving one property of an aluminum alloy without degrading another property is elusive. For example, it is difficult to increase the strength of an aluminum casting alloy without affecting other properties such as castability and ductility. See, for example, U.S. Pat. No. 6,773,666.

SUMMARY

Broadly, the present patent application relates to improved 3xx aluminum casting alloys, and methods for producing the same. The new 3xx aluminum casting alloys generally comprise (and in some instance consist essentially of, or consist of), 6.5-11.0 wt. % Si (silicon), 0.20-0.80 wt. % Mg (magnesium), 0.05-0.50 wt. % Cu (copper), 0.10-0.80 wt. % Mn (manganese), 0.005-0.050 wt. % Sr (strontium), up to 0.25 wt. % Ti (titanium), up to 0.30 wt. % Fe (iron), up to 0.20 wt. % Zn (zinc), the balance being aluminum (Al) and impurities. FIG. 1 provides various non-limiting embodiments of the new 3xx aluminum casting alloy. The new 3xx aluminum casting alloys may realize, for instance, an improved combination of strength and castability, among other properties. The new 3xx aluminum alloys may shape cast (e.g., via high-pressure die casting (HPDC)), and subsequently tempered (e.g., to a T4, T5, T6, or T7 temper).

Regarding silicon, the new 3xx aluminum casting alloys generally include from 6.5 to 11.0 wt. % Si. In one embodiment, a new 3xx aluminum casting alloy includes at least 7.0 wt. % Si. In another embodiment, a new 3xx aluminum casting alloy includes at least 7.25 wt. % Si. In yet another embodiment, a new 3xx aluminum casting alloy includes at least 7.5 wt. % Si. In another embodiment, a new 3xx aluminum casting alloy includes at least 7.75 wt. % Si. In yet another embodiment, a new 3xx aluminum casting alloy includes at least 8.0 wt. % Si. In another embodiment, a new 3xx aluminum casting alloy includes at least 8.25 wt. % Si. In another embodiment, a new 3xx aluminum casting alloy includes at least 8.40 wt. % Si. In yet another embodiment, a new 3xx aluminum casting alloy includes at least 8.50 wt. % Si. In another embodiment, a new 3xx aluminum casting alloy includes at least 8.60 wt. % Si. In one embodiment, a new 3xx aluminum casting alloy includes not greater than 10.75 wt. % Si. In another embodiment, a new 3xx aluminum casting alloy includes not greater than 10.5 wt. % Si. In yet another embodiment, a new 3xx aluminum casting alloy includes not greater than 10.25 wt. % Si. In another embodiment, a new 3xx aluminum casting alloy includes not greater than 10.0 wt. % Si. In another embodiment, a new 3xx aluminum casting alloy includes not greater than 9.75 wt. % Si. In another embodiment, a new 3xx aluminum casting alloy includes not greater than 9.50 wt. % Si. In yet another embodiment, a new 3xx aluminum casting alloy includes not greater than 9.25 wt. % Si. In another embodiment, a new 3xx aluminum casting alloy includes not greater than 9.00 wt. % Si. In yet another embodiment, a new 3xx aluminum casting alloy includes not greater than 8.90 wt. % Si.

The new 3xx aluminum casting alloys generally include magnesium in the range of from 0.20 to 0.80 wt. % Mg. In one embodiment, a new 3xx aluminum casting alloy includes at least 0.30 wt. % Mg. In another embodiment, a new 3xx aluminum casting alloy includes at least 0.40 wt. % Mg. In yet another embodiment, a new 3xx aluminum casting alloy includes at least 0.45 wt. % Mg. In another embodiment, a new 3xx aluminum casting alloy includes at least 0.50 wt. % Mg. In yet another embodiment, a new 3xx aluminum casting alloy includes at least 0.55 wt. % Mg. In another embodiment, a new 3xx aluminum casting alloy includes at least 0.60 wt. % Mg. In one embodiment, a new 3xx aluminum casting alloy includes not greater than 0.75 wt. % Mg. In another embodiment, a new 3xx aluminum casting alloy includes not greater than 0.725 wt. % Mg. In yet another embodiment, a new 3xx aluminum casting alloy includes not greater than 0.70 wt. % Mg. In another embodiment, a new 3xx aluminum casting alloy includes not greater than 0.675 wt. % Mg. In yet another embodiment, a new 3xx aluminum casting alloy includes not greater than 0.65 wt. % Mg.

The new 3xx aluminum casting alloys generally include copper and in the range of from 0.05 to 0.50 wt. % Cu. As shown below, use of copper may facilitate, for example, improved strength. Too much copper may unacceptably degrade corrosion resistance. In one embodiment, a new 3xx aluminum casting alloy includes at least 0.075 wt. % Cu. In another embodiment, a new 3xx aluminum casting alloy includes at least 0.10 wt. % Cu. In yet another embodiment, a new 3xx aluminum casting alloy includes at least 0.125 wt. % Cu. In another embodiment, a new 3xx aluminum casting alloy includes at least 0.15 wt. % Cu. In yet another embodiment, a new 3xx aluminum casting alloy includes at least 0.18 wt. % Cu. In one embodiment, a new 3xx aluminum casting alloy includes not greater than 0.45 wt. % Cu. In another embodiment, a new 3xx aluminum casting alloy includes not greater than 0.40 wt. % Cu. In yet another embodiment, a new 3xx aluminum casting alloy includes not greater than 0.35 wt. % Cu. In another embodiment, a new 3xx aluminum casting alloy includes not greater than 0.30 wt. % Cu. In yet another embodiment, a new 3xx aluminum casting alloy includes not greater than 0.25 wt. % Cu.

The new 3xx aluminum casting alloys generally include from 0.10 to 0.80 wt. % Mn. As shown below, manganese may facilitate, for example, improved die sticking resistance (sometimes called die soldering resistance), which can be problematic when casting via high-pressure die casting. In one embodiment, a new 3xx aluminum casting alloy includes at least 0.15 wt. % Mn. In another embodiment, a new 3xx aluminum casting alloy includes at least 0.20 wt. % Mn. In yet another embodiment, a new 3xx aluminum casting alloy includes at least 0.25 wt. % Mn. In another embodiment, a new 3xx aluminum casting alloy includes at least 0.30 wt. % Mn. In another embodiment, a new 3xx aluminum casting alloy includes at least 0.35 wt. % Mn. In another embodiment, a new 3xx aluminum casting alloy includes at least 0.40 wt. % Mn. In another embodiment, a new 3xx aluminum casting alloy includes at least 0.45 wt. % Mn. In one embodiment, a new 3xx aluminum casting alloy includes not greater than 0.75 wt. % Mn. In another embodiment, a new 3xx aluminum casting alloy includes not greater than 0.70 wt. % Mn. In yet another embodiment, a new 3xx aluminum casting alloy includes not greater than 0.65 wt. % Mn. In another embodiment, a new 3xx aluminum casting alloy includes not greater than 0.60 wt. % Mn.

The new 3xx aluminum casting alloys generally include from 0.005 (50 ppm) to 0.050 wt. % (500 ppm) Sr. Strontium modifies the aluminum-silicon eutectic. In one embodiment, a new 3xx aluminum casting alloy includes at least 0.008 wt. % Sr. In another embodiment, a new 3xx aluminum casting alloy includes at least 0.010 wt. % Sr. In yet another embodiment, a new 3xx aluminum casting alloy includes at least 0.012 wt. % Sr. In one embodiment, a new 3xx aluminum casting alloy includes not greater than 0.040 wt. % Sr. In another embodiment, a new 3xx aluminum casting alloy includes not greater than 0.030 wt. % Sr. In yet another embodiment, a new 3xx aluminum casting alloy includes not greater than 0.025 wt. % Sr. In another embodiment, a new 3xx aluminum casting alloy includes not greater than 0.022 wt. % Sr. In yet another embodiment, a new 3xx aluminum casting alloy includes not greater than 0.020 wt. % Sr. In yet another embodiment, a new 3xx aluminum casting alloy includes not greater than 0.018 wt. % Sr. In yet another embodiment, a new 3xx aluminum casting alloy includes not greater than 0.016 wt. % Sr. In some instances, sodium and/or antimony may be used as a substitute (in whole or in part) for strontium.

The new 3xx aluminum casting alloys may include up to 0.25 wt. % titanium. Titanium may facilitate grain refining. In embodiments where titanium is present, the new 3xx aluminum casting alloys generally include from 0.005 to 0.25 wt. % Ti. In one embodiment, the new 3xx aluminum casting alloys includes from 0.005 to 0.20 wt. % Ti. In one embodiment, the new 3xx aluminum casting alloys includes from 0.005 to 0.15 wt. % Ti. When used, the appropriate amount of titanium can be readily selected by those skilled in the art. See, ASM International Metal Handbook, Vol. 15, Casting (1988), pp. 746 and 750-751, which is incorporated herein by reference in its entirety. In some embodiments, the new 3xx aluminum casting alloys are substantially free of titanium, and, in these embodiments, contain less than 0.005 wt. % Ti (e.g., in some high-pressure die casting operations).

The new 3xx casting alloys may include up to 0.30 wt. % Fe. Excess iron may detrimentally impact ductility. In one embodiment, a new 3xx aluminum casting alloy includes not greater than 0.25 wt. % Fe. In another embodiment, a new 3xx aluminum casting alloy includes not greater than 0.20 wt. % Fe. In yet another embodiment, a new 3xx aluminum casting alloy includes not greater than 0.15 wt. % Fe. In another embodiment, a new 3xx aluminum casting alloy includes not greater than 0.14 wt. % Fe. In yet another embodiment, a new 3xx aluminum casting alloy includes not greater than 0.13 wt. % Fe. In another embodiment, a new 3xx aluminum casting alloy includes not greater than 0.12 wt. % Fe. In yet another embodiment, a new 3xx aluminum casting alloy includes not greater than 0.11 wt. % Fe. In another embodiment, a new 3xx aluminum casting alloy includes not greater than 0.10 wt. % Fe. The new 3xx aluminum casting alloy generally include at least 0.01 wt. % Fe.

The new 3xx casting alloys may include up to 0.20 wt. % Zn as an impurity Excess zinc may detrimentally impact properties. However, some zinc may be inevitable as an unavoidable impurity. In one embodiment, a new 3xx aluminum casting alloy includes not greater than 0.15 wt. % Zn. In another embodiment, a new 3xx aluminum casting alloy includes not greater than 0.10 wt. % Zn. In yet another embodiment, a new 3xx aluminum casting alloy includes not greater than 0.07 wt. % Zn. In another embodiment, a new 3xx aluminum casting alloy includes not greater than 0.05 wt. % Zn. In yet another embodiment, a new 3xx aluminum casting alloy includes not greater than 0.03 wt. % Zn. In some of the embodiments, the new 3xx aluminum casting alloy may include at least 0.01 wt. % Zn.

The remainder of the new 3xx aluminum casting alloy generally comprises aluminum and impurities ("impurities" means all unavoidable impurities except iron and zinc, which are described above and have their own individual limits). Generally, the new 3xx aluminum casting contains not more than 0.10 wt. % each of impurities, with the total combined amount of the impurities not exceeding 0.35 wt. %. In another embodiment, each one of the impurities, individually, does not exceed 0.05 wt. % in the new 3xx aluminum casting alloys, and the total combined amount of the impurities does not exceed 0.15 wt. % in the new 3xx aluminum casting alloys. In another embodiment, each one of the impurities, individually, does not exceed 0.04 wt. % in the new 3xx aluminum casting alloys, and the total combined amount of the impurities does not exceed 0.12 wt. % in the new 3xx aluminum casting alloys. In another embodiment, each one of the impurities, individually, does not exceed 0.03 wt. % in the new 3xx aluminum casting alloys, and the total combined amount of the impurities does not exceed 0.10 wt. % in the new 3xx aluminum casting alloys.

In one approach, a new 3xx aluminum casting alloy consists of 8.0-9.5 wt. % Si, 0.20-0.80 wt. % Mg, 0.15-0.50 wt. % Cu, 0.10-0.80 wt. % Mn, 0.005-0.025 wt. % Sr, up to 0.20 wt. % Ti, up to 0.20 wt. % Fe, and up to 0.10 wt. % Zn, and the balance being aluminum (Al) and impurities, wherein the aluminum casting alloy includes not greater than 0.05 wt. % of any one impurity, and wherein the aluminum casting alloy includes not greater than 0.15 wt. %, in total, of the impurities. In one embodiment, this new 3xx aluminum casting alloy consists of 8.4-9.0 wt. % Si, 0.60-0.80 wt. % Mg, 0.18-0.25 wt. % Cu, 0.35-0.45 wt. % Mn, 0.015-0.020 wt. % Sr, up to 0.15 wt. % Ti, up to 0.12 wt. % Fe, and up to 0.07 wt. % Zn, the balance being aluminum (Al) and impurities, wherein the aluminum casting alloy includes not greater than 0.04 wt. % of any one impurity, and wherein the aluminum casting alloy includes not greater than 0.12 wt. %, in total, of the impurities. In one, a high pressure die casting made from such 3xx aluminum casting alloys realizes a tensile yield strength of at least 280 MPa, an elongation of at least 6%, and a Quality Index (QI) of at least 400 in the T6 temper.

In one embodiment, the new 3xx aluminum casting alloy is cast into a 3xx shape cast part/product. In this regard, the casting step may be high pressure die casting (e.g., vacuum assisted die casting), gravity permanent mold, semi-permanent mold, squeeze, sand mold, spin/centrifugal, or ablation casting. After the casting, the 3xx casting alloy may be machined and/or tempered. The tempering may include solution heat treating, and then quenching, and then naturally and/or artificially aging. Suitable tempers include the T4, T5, T6, and T7 tempers, for instance. The temper designations used herein are per ANSI H35.1 (2009).

The 3xx shape cast parts made from the new 3xx aluminum casting alloys may be used in any suitable application, such as in any of an automotive, aerospace, industrial or commercial transportation application, among others. In one embodiment, the 3xx shape cast part is an automotive part (e.g., a body-in-white (BIW) part; a suspension part). In one embodiment, the 3xx shape cast part is included in an automobile. In one embodiment, the 3xx shape cast part is an aerospace part. In one embodiment, the 3xx shape cast part is included in an aerospace vehicle. In one embodiment, the 3xx shape cast part is an industrial part. In one embodiment, the 3xx shape cast part is a commercial transportation part. In one embodiment, the 3xx shape cast part is included in a commercial transportation vehicle.

In one embodiment, a new 3xx shape cast part includes a sufficient amount of the above alloying elements (Si, Mg, Cu, Mn, Sr, Ti, Fe, Zn, Al, and impurities) to achieve a tensile yield strength of at least 265 MPa, when testing in accordance with ASTM E8 and B557. In another embodiment, a new 3xx shape cast part includes a sufficient amount of the above alloying elements (Si, Mg, Cu, Mn, Sr, Ti, Fe, Zn, Al, and impurities) to achieve a tensile yield strength of at least 270 MPa. In another embodiment, a new 3xx shape cast part includes a sufficient amount of the above alloying elements (Si, Mg, Cu, Mn, Sr, Ti, Fe, Zn, Al, and impurities) to achieve a tensile yield strength of at least 275 MPa. In another embodiment, a new 3xx shape cast part includes a sufficient amount of the above alloying elements (Si, Mg, Cu, Mn, Sr, Ti, Fe, Zn, Al, and impurities) to achieve a tensile yield strength of at least 280 MPa. In another embodiment, a new 3xx shape cast part includes a sufficient amount of the above alloying elements (Si, Mg, Cu, Mn, Sr, Ti, Fe, Zn, Al, and impurities) to achieve a tensile yield strength of at least 285 MPa. In another embodiment, a new 3xx shape cast part includes a sufficient amount of the above alloying elements (Si, Mg, Cu, Mn, Sr, Ti, Fe, Zn, Al, and impurities) to achieve a tensile yield strength of at least 290 MPa. In another embodiment, a new 3xx shape cast part includes a sufficient amount of the above alloying elements (Si, Mg, Cu, Mn, Sr, Ti, Fe, Zn, Al, and impurities) to achieve a tensile yield strength of at least 295 MPa. In another embodiment, a new 3xx shape cast part includes a sufficient amount of the above alloying elements (Si, Mg, Cu, Mn, Sr, Ti, Fe, Zn, Al, and impurities) to achieve a tensile yield strength of at least 300 MPa, or more. Accompanying these strength embodiments, the new 3xx shape cast part may also realize an elongation of at least 5%. In one embodiment, the new 3xx shape cast part should also realize an elongation of at least 6%. In another embodiment, the new 3xx shape cast part should also realize an elongation of at least 7%. In another embodiment, the new 3xx shape cast part should also realize an elongation of at least 8%, or more.

In one embodiment, a new 3xx shape cast part includes a sufficient amount of the above alloying elements (Si, Mg, Cu, Mn, Sr, Ti, Fe, Zn, Al, and impurities) to achieve a Quality Index (QI) of at least 400, wherein QI=UTS(MPa)+150*log(Elongation). In another embodiment, a new 3xx shape cast part includes a sufficient amount of the above alloying elements (Si, Mg, Cu, Mn, Sr, Ti, Fe, Zn, Al, and impurities) to achieve a Quality Index (QI) of at least 410. In another embodiment, a new 3xx shape cast part includes a sufficient amount of the above alloying elements (Si, Mg, Cu, Mn, Sr, Ti, Fe, Zn, Al, and impurities) to achieve a Quality Index (QI) of at least 420. In another embodiment, a new 3xx shape cast part includes a sufficient amount of the above alloying elements (Si, Mg, Cu, Mn, Sr, Ti, Fe, Zn, Al, and impurities) to achieve a Quality Index (QI) of at least 430. In another embodiment, a new 3xx shape cast part includes a sufficient amount of the above alloying elements (Si, Mg, Cu, Mn, Sr, Ti, Fe, Zn, Al, and impurities) to achieve a Quality Index (QI) of at least 440. In another embodiment, a new 3xx shape cast part includes a sufficient amount of the above alloying elements (Si, Mg, Cu, Mn, Sr, Ti, Fe, Zn, Al, and impurities) to achieve a Quality Index (QI) of at least 450. In another embodiment, a new 3xx shape cast part includes a sufficient amount of the above alloying elements (Si, Mg, Cu, Mn, Sr, Ti, Fe, Zn, Al, and impurities) to achieve a Quality Index (QI) of at least 460, or more.

In one embodiment, a new 3xx shape cast part includes a sufficient amount of the above alloying elements (Si, Mg, Cu, Mn, Sr, Ti, Fe, Zn, Al, and impurities) to realize a tensile yield strength of at least 280 MPa, an elongation of at least 6%, and a Quality Index (QI) of at least 400.

In one embodiment, a new 3xx shape cast part includes a sufficient amount of the above alloying elements (Si, Mg, Cu, Mn, Sr, Ti, Fe, Zn, Al, and impurities) to achieve a tensile yield strength that is at least 5% better than the tensile yield strength of a baseline shape cast part, wherein the baseline shape cast part has the same product form, dimensions, geometry, and temper as the new 3xx shape cast part, but the baseline shape cast part is made from conventional alloy A365, wherein the tensile yield strength is tested in accordance with ASTM E8 and B557. In another embodiment, a new 3xx shape cast part includes a sufficient amount of the above alloying elements (Si, Mg, Cu, Mn, Sr, Ti, Fe, Zn, Al, and impurities) to achieve a tensile yield strength that is at least 10% better than the tensile yield strength of a baseline shape cast part made from conventional alloy A365. In another embodiment, a new 3xx shape cast part includes a sufficient amount of the above alloying elements (Si, Mg, Cu, Mn, Sr, Ti, Fe, Zn, Al, and impurities) to achieve a tensile yield strength that is at least 15% better than the tensile yield strength of a baseline shape cast part made from conventional alloy A365. In another embodiment, a new 3xx shape cast part includes a sufficient amount of the above alloying elements (Si, Mg, Cu, Mn, Sr, Ti, Fe, Zn, Al, and impurities) to achieve a tensile yield strength that is at least 20% better than the tensile yield strength of a baseline shape cast part made from conventional alloy A365. In some of the above embodiments, the new 3xx shape cast part may realize equivalent or better elongation as compared to a baseline shape cast part made from conventional alloy A365.

In one embodiment, a new 3xx shape cast part includes a sufficient amount of the above alloying elements (Si, Mg, Cu, Mn, Sr, Ti, Fe, Zn, Al, and impurities) to achieve an average staircase fatigue strength that is at least 5% better than the average staircase fatigue strength of a baseline shape cast part, wherein the baseline shape cast part has the same product form, dimensions, geometry, and temper as the new 3xx shape cast part, but the baseline shape cast part is made from conventional alloy A365, wherein the average staircase fatigue strength is tested in accordance with ASTM E466-15. In another embodiment, a new 3xx shape cast part includes a sufficient amount of the above alloying elements (Si, Mg, Cu, Mn, Sr, Ti, Fe, Zn, Al, and impurities) to achieve an average staircase fatigue strength that is at least 10% better that the average staircase fatigue strength of a baseline shape cast part made from conventional alloy A365. In another embodiment, a new 3xx shape cast part includes a sufficient amount of the above alloying elements (Si, Mg, Cu, Mn, Sr, Ti, Fe, Zn, Al, and impurities) to achieve an average staircase fatigue strength that is at least 15% better that the average staircase fatigue strength of a baseline shape cast part made from conventional alloy A365. In another embodiment, a new 3xx shape cast part includes a sufficient amount of the above alloying elements (Si, Mg, Cu, Mn, Sr, Ti, Fe, Zn, Al, and impurities) to achieve an average staircase fatigue strength that is at least 20% better that the average staircase fatigue strength of a baseline shape cast part made from conventional alloy A365.

In one embodiment, a new 3xx shape cast part includes a sufficient amount of the above alloying elements (Si, Mg, Cu, Mn, Sr, Ti, Fe, Zn, Al, and impurities) to achieve an intergranular corrosion resistance that is comparable to the intergranular corrosion resistance of a baseline shape cast part (e.g., the same product form, dimensions, geometry, temper) but made from conventional alloy A365, wherein the intergranular corrosion resistance is tested in accordance with ASTM G110-92(2015), measured on the as-cast shape cast part (not machined) after 24 hours of exposure.

As used herein, ASTM E8 refers to "ASTM E8/E8M-15a—Standard Test Methods for Tension Testing of Metallic Materials."

As used herein, ASTM B557 refers to "ASTM B557-15—Standard Test Methods for Tension Testing Wrought and Cast Aluminum- and Magnesium-Alloy Products."

As used herein, ASTM E466 refers to "ASTM E466-15—Standard Practice for Conducting Force Controlled Constant Amplitude Axial Fatigue Tests of Metallic Materials."

As used herein, ASTM G110 refers to "ASTM G110-92 (2015)—Standard Practice for Evaluating Intergranular Corrosion Resistance of Heat Treatable Aluminum Alloys by Immersion in Sodium Chloride+Hydrogen Peroxide Solution."

As used herein, alloy A365 means Aluminum Association alloy 365.0, formerly Silafont-36, defined in Aluminum Association document "Designations and Chemical Composition Limits for Aluminum Alloys in the Form of Castings and Ingot" (2009), having 9.5-11.5 wt. % Si, up to 0.15 wt. % Fe (impurity), up to 0.03 wt. % Cu (impurity), 0.50-0.8 wt. % Mn, 0.10-0.50 wt. % Mg, up to 0.07 wt. % Zn (impurity), 0.04-0.15 wt. % Ti, the balance being aluminum and other impurities (other than Fe, Cu, and Zn), wherein the 365.0 alloy contains not greater than 0.03 wt. % of any one of these other impurities, and wherein the 365.0 alloy contains not greater than 0.10 wt. % in total of these other impurities.

BRIEF DESCRIPTION OF THE DRAWINGS

FIG. 1 provides various embodiments of the new 3xx aluminum casting alloys.

FIG. 2 shows ASTM G110 corrosion data for various Example 1 alloys.

FIGS. 3*a*-3*c* are graphs showing various properties of the Example 2 alloys.

FIGS. 4*a*-4*c* are graphs showing the effect of copper, magnesium and silicon relative to the Example 2 alloys.

DETAILED DESCRIPTION

EXAMPLE 1

Figure 5:
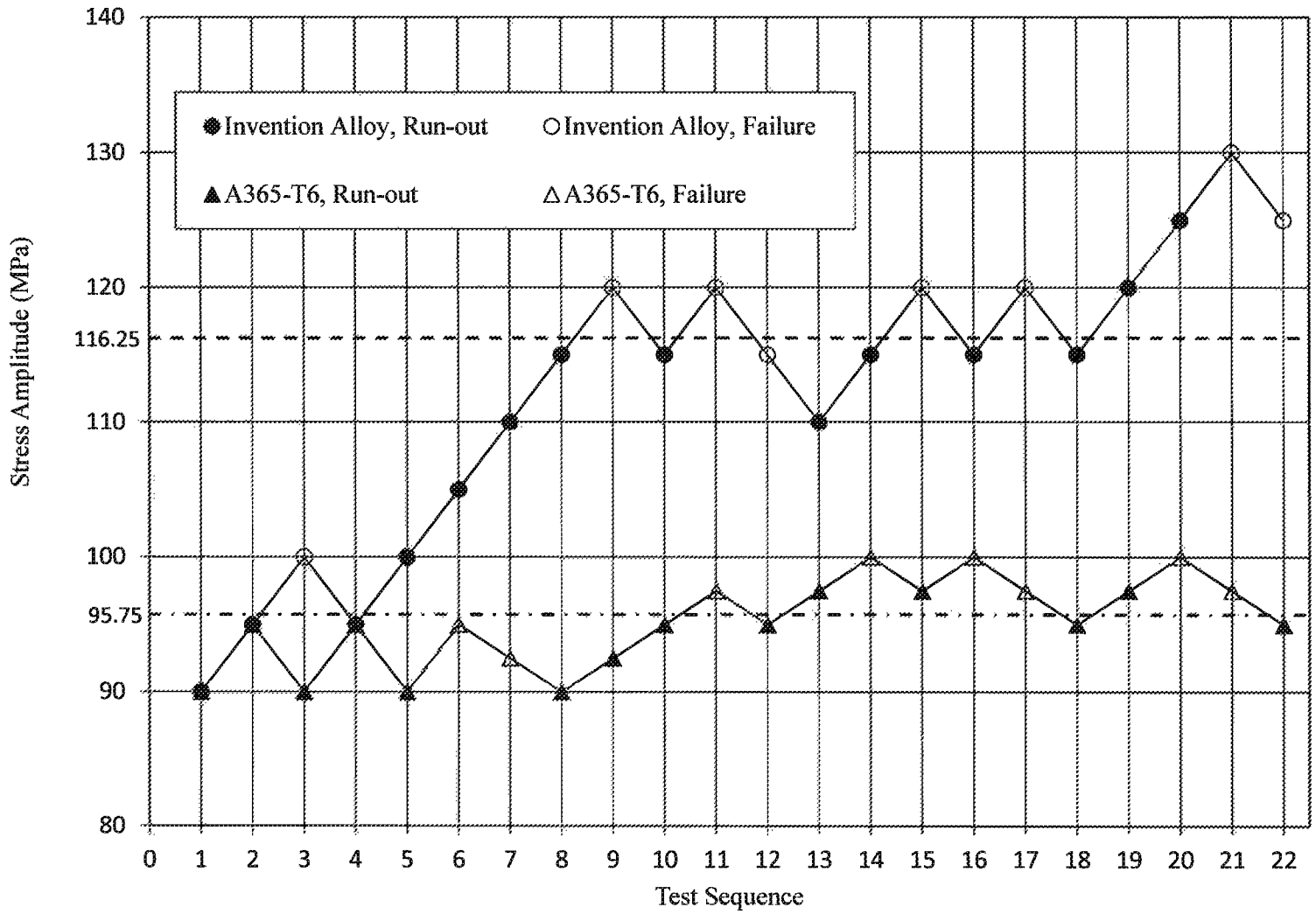
FIG. 5 is a graph showing the staircase fatigue results of Example 3.

Several 3xx aluminum casting alloys having the compositions shown in Table 1, below, were cast via directional solidification (DS). The dimensions of the directionally solidified alloys were approximately 25.4 mm (1 inch) thick, 102 mm (4 inches) wide, and 254 mm (10 inches) long.

TABLE 1

Composition of Example 1 Alloys (in wt. %)

| Alloy** | Si | Fe | Cu | Mn | Mg | Sr |
|---|---|---|---|---|---|---|
| A1 | 8.59 | 0.11 | — | 0.51 | 0.55 | 0.012 |
| A2* | 8.48 | 0.11 | 0.20 | 0.50 | 0.54 | 0.012 |
| A3 | 8.60 | 0.11 | 0.51 | 0.51 | 0.54 | 0.018 |

*Invention alloy

**All alloys contained $TiB_2$ as a grain refiner, and about 0.010-0.020 wt. % Ti; the balance of the alloys was aluminum and unavoidable impurities, with the alloys containing not greater than 0.03 wt. % of any one unavoidable impurity, and not greater than 0.10 wt. % total of the unavoidable impurities; the alloys contained not greater than 0.03 wt. % Zn.

After casting, the alloys were solution heated and then quenching in cold water. After holding for 12-24 hours, various specimens from the alloys were artificially aged at 190° C. (374° F.) for various times. Strength testing in accordance with ASTM B557-10 was then conducted, the results of which are provided in Table 2, below (all values the average of at least triplicate specimens).

TABLE 2

Mechanical Properties of Alloys A1-A3

| Alloy | Aging Time (hrs. @ 190° C.) | TYS (MPa) | UTS (MPa) | Elong. (%) |
|---|---|---|---|---|
| A1 (0 Cu) | 1 | 278.4 | 324.8 | 7.3 |
| A1 (0 Cu) | 2 | 285.0 | 322.8 | 4.3 |
| A1 (0 Cu) | 4 | 277.6 | 310.0 | 4.0 |
| A2 (0.20% Cu) | 1 | 291.3 | 341.3 | 6.3 |
| A2 (0.20% Cu) | 2 | 298.1 | 338.6 | 4.5 |
| A2 (0.20% Cu) | 4 | 289.8 | 323.0 | 3.8 |
| A3 (0.51% Cu) | 1 | 285.5 | 350.0 | 6.4 |
| A3 (0.51% Cu) | 2 | 294.8 | 346.2 | 5.7 |
| A3 (0.51% Cu) | 4 | 286.0 | 324.9 | 4.8 |

As shown, peak strength was achieved by artificial aging at 190° C. for 2 hours for all three alloys. Adding 0.2 wt. % Cu increased peak yield strength by 13 MPa, whereas adding 0.51 wt. % Cu only increases peak yield strength by 10 MPa. Elongation decreases with increasing aging time.

The corrosion resistance of the alloys aged at 190° C. for 2 hours was also evaluated in accordance with ASTM G110 (2009), entitled "Standard Practice for Evaluating Intergranular Corrosion Resistance of Heat Treatable Aluminum Alloys by Immersion in Sodium Chloride+Hydrogen Peroxide Solution". Corrosion mode and depth-of-attack on both the as-cast surface and machined surface were assessed. The depth of attack results are shown in FIG. 2. Increasing Cu content from 0.20 wt. % to 0.51 wt. % increased the depth-of-attack by 30 to 40%.

EXAMPLE 2

Several 3xx aluminum casting alloys having the compositions shown in Table 3, below, were cast via directional solidification (DS). The dimensions of the directionally solidified alloys were approximately 25.4 mm (1 inch) thick, 102 mm (4 inches) wide, and 254 mm (10 inches) long.

TABLE 3

Composition of Example 2 Alloys

| Alloy* | Si | Mg | Cu | Mn | Fe | Sr |
|---|---|---|---|---|---|---|
| B1 | 8.91 | 0.65 | 0.11 | 0.55 | 0.10 | 0.013 |
| B2 | 8.76 | 0.65 | 0.26 | 0.54 | 0.09 | 0.013 |

TABLE 3-continued

| Composition of Example 2 Alloys | | | | | | |
|---|---|---|---|---|---|---|
| Alloy* | Si | Mg | Cu | Mn | Fe | Sr |
| B3 | 8.76 | 0.65 | 0.34 | 0.54 | 0.09 | 0.013 |
| B4 | 8.81 | 0.62 | 0.44 | 0.54 | 0.09 | 0.007 |
| B5 | 8.22 | 0.39 | 0.19 | 0.52 | 0.10 | 0.014 |
| B6 | 8.10 | 0.55 | 0.18 | 0.50 | 0.10 | 0.014 |
| B7 | 8.14 | 0.74 | 0.18 | 0.50 | 0.10 | 0.014 |
| B8 | 5.49 | 0.55 | 0.22 | 0.55 | 0.10 | 0.017 |
| B9 | 6.91 | 0.53 | 0.21 | 0.54 | 0.11 | 0.016 |
| B10 | 8.18 | 0.54 | 0.19 | 0.50 | 0.10 | 0.012 |
| B11 | 9.52 | 0.53 | 0.19 | 0.50 | 0.10 | 0.012 |
| B12 | 10.86 | 0.52 | 0.20 | 0.50 | 0.11 | 0.013 |

*All alloys contained $TiB_2$ as a grain refiner, and about 0.010-0.020 wt. % Ti; the balance of the alloys was aluminum and unavoidable impurities, with the alloys containing not greater than 0.03 wt. % of any one unavoidable impurity, and not greater than 0.10 wt. % total of the unavoidable impurities; the alloys contained not greater than 0.03 wt. % Zn.

After casting, the alloys were solution heated and then quenching in cold water. After holding for 12-24 hours, various specimens from the alloys were artificially aged at 190° C. (374° F.) for various times. Mechanical properties of the artificially aged materials were then tested (duplicate specimens at two locations of each casting for each aging condition), the results of which are shown in Tables 4-6, below (average and standard deviation of the four total specimens per cast and per aging condition). The quality index is shown in Table 7 (QI=UTS(MPa)+150*log(Elongation). The mechanical properties of alloy B1 had a large standard deviation and were inconsistent with other alloy testing, so those tests were excluded.

TABLE 4

| Tensile Yield Strength | | | |
|---|---|---|---|
| | Average | | |
| Alloy | 1 hr @ 190 C. | 2 hr @ 190 C. | 4 hr @ 190 C. |
| B1 | N/A | N/A | N/A |
| B2 | 273.2 | 295.4 | 299.7 |
| B3 | 274.7 | 277.8 | 277.3 |
| B4 | 263.9 | 273.5 | 274.4 |
| B5 | 267.2 | 267.5 | 260.6 |
| B6 | 272.7 | 275.3 | 275.3 |
| B7 | 272.8 | 274.4 | 272.5 |
| B8 | 271.1 | 282.0 | 276.3 |
| B9 | 280.4 | 287.3 | 283.9 |
| B10 | 279.6 | 281.8 | 271.8 |
| B11 | 268.5 | 270.4 | 268.0 |
| B12 | 266.5 | 268.4 | 267.7 |

TABLE 5

| Ultimate Tensile Strength | | | |
|---|---|---|---|
| | Average | | |
| Alloy | 1 hr @ 190 C. | 2 h r@ 190 C. | 4 hr @ 190 C. |
| B1 | N/A | N/A | N/A |
| B2 | 321.6 | 328.8 | 318.1 |
| B3 | 325.7 | 319.4 | 310.9 |
| B4 | 319.5 | 320.2 | 312.5 |
| B5 | 321.4 | 311.8 | 296.3 |
| B6 | 323.7 | 313.7 | 313.7 |
| B7 | 317.1 | 310.1 | 300.2 |
| B8 | 288.3 | 299.9 | 289.7 |
| B9 | 321.6 | 319.0 | 308.8 |

TABLE 5-continued

| Ultimate Tensile Strength | | | |
|---|---|---|---|
| | Average | | |
| Alloy | 1 hr @ 190 C. | 2 h r@ 190 C. | 4 hr @ 190 C. |
| B10 | 331.8 | 320.7 | 303.2 |
| B11 | 316.6 | 311.4 | 304.0 |
| B12 | 319.5 | 312.8 | 308.0 |

TABLE 6

| Elongation | | | |
|---|---|---|---|
| | Average | | |
| Alloy | 1 hr @ 190 C. | 2 hr @ 190 C. | 4 hr @ 190 C. |
| B1 | N/A | N/A | N/A |
| B2 | 9.8 | 4.4 | 4.3 |
| B3 | 11.5 | 8.7 | 7.9 |
| B4 | 10.6 | 6.2 | 4.3 |
| B5 | 11.5 | 6.8 | 5.5 |
| B6 | 9.8 | 6.4 | 5.2 |
| B7 | 8.8 | 4.1 | 3.3 |
| B8 | 2.2 | 0.6 | 0.8 |
| B9 | 5.2 | 2.7 | 2.3 |
| B10 | 8.7 | 4.4 | 3.0 |
| B11 | 7.1 | 5.5 | 3.9 |
| B12 | 8.8 | 5.9 | 8.0 |

TABLE 7

| Quality Index | | | |
|---|---|---|---|
| | Average | | |
| Alloy | 1 hr @ 190 C. | 2 hr @ 190 C. | 4 hr @ 190 C. |
| B1 | N/A | N/A | N/A |
| B2 | 470.3 | 425.3 | 413.1 |
| B3 | 484.8 | 460.3 | 445.5 |
| B4 | 473.3 | 439.1 | 407.5 |
| B5 | 480.5 | 436.7 | 407.4 |
| B6 | 472.4 | 434.6 | 421.1 |
| B7 | 458.8 | 402.0 | 378.0 |
| B8 | 339.7 | 266.6 | 275.2 |
| B9 | 429.0 | 383.7 | 363.1 |
| B10 | 472.7 | 417.2 | 374.8 |
| B11 | 444.3 | 422.5 | 392.7 |
| B12 | 461.2 | 428.4 | 443.5 |

As shown, all alloys, except Alloy B8, realize an excellent combination of strength and ductility. Thus, alloys B2-B7 and B9-B12 of Example 2 are considered invention alloys. Of these, the alloys having about 0.2-0.4 wt. % Cu and about 0.5-0.7 wt. % Mg are better performing (alloys B2-B3, B4, B6, and B9-12). Alloys B2-B3 and B10, with 8.16-8.76 wt. % Si, 0.54-0.65 wt. % Mg, and 0.19-0.34 wt. % Cu, tend to realize the best combination of strength and elongation.

EXAMPLE 3

Several cast nodes (approx. 30) were high pressure die cast for an automotive frame structure on a 1350-tonne vacuum-assisted HPDC machine. The average measured composition is provided in Table 8, below. The cast nodes showed no die sticking and no hot cracking. The invention alloy showed good fluidity, completely filling the 2-5 mm thin wall casting part; zero non-fill issues were identified.

TABLE 8

Composition of Example 3 Alloy*

| Cu | Mg | Si | Fe | Mn | Sr |
|---|---|---|---|---|---|
| 0.19 | 0.60 | 8.85 | 0.17 | 0.42 | 0.017 |

*The alloy contained $TiB_2$ as a grain refiner, and about 0.05 wt. % Ti; the balance of the alloys was aluminum and unavoidable impurities, with the alloys containing not greater than 0.03 wt. % of any one unavoidable impurity, and not greater than 0.10 wt. % total of the unavoidable impurities; the amount of zinc in the alloy was not greater than 0.03 wt. % Zn.

After casting, the materials were solution heat treated, quenched and processed to the T6 temper by artificially aging at 180° C. (356° F.) for 4 hours. Tensile specimens were taken from different locations of one cast node, and tensile tests were performed per ASTM Method B557-10. Table 2 shows the tensile results. The average yield strength is 300 MPa, and average elongation is 8.3%.

TABLE 9

Mechanical Properties of a Cast Node

| Specimen ID | Thickness, mm | Yield Strength, Mpa | Tensile Strength, Mpa | Elongation, % |
|---|---|---|---|---|
| 1 | 3.47 | 295 | 360.5 | 10 |
| 2 | 2.8 | 302.5 | 364.5 | 10 |

TABLE 9-continued

Mechanical Properties of a Cast Node

| Specimen ID | Thickness, mm | Yield Strength, Mpa | Tensile Strength, Mpa | Elongation, % |
|---|---|---|---|---|
| 3 | 3.09 | 296.5 | 360.5 | 10 |
| 4 | 2.73 | 311.5 | 367.5 | 10 |
| 5 | 2.87 | 298.5 | 347.5 | 6 |
| 6 | 3.3 | 304.5 | 353 | 6 |
| 7 | 1.1 | 298.5 | 348 | 6 |
| 8 | 2.55 | 300.5 | 358 | 6 |
| 9 | 5.59 | 295 | 357 | 10 |
| 10 | 4.61 | 300 | 359 | 10 |
| 11 | 3.34 | 302 | 356 | 10 |
| 12 | 2.73 | 300.5 | 356 | 6 |
| Average | 3.18 | 300.4 | 357.3 | 8.33 |

Tensile tests were also performed for the incumbent A365 alloy using the castings made on the same HPDC machine using the same casting process, solution heat treatment and artificial aging practice. The average mechanical properties achieved for the A365 alloy were 247 MPa yield strength, 309MPa tensile strength and 8.7% elongation. The invention alloy, therefore, realizes about 20% higher yield strength than the conventional A365 alloy while maintaining similar elongation.

Welding tests and corrosion tests were also conducted on an invention alloy cast node and conventional alloy A365 cast node. The alloys were welded to conventional 6082 extruded rod using gas metal arc welding (GMAW). Good quality welds between the invention alloy cast node and the 6082 extruded rod were obtained, with no substantive cracks or discontinuity in the weld zone. Corrosion resistance testing per ASTM G110 were conducted on the bare and welded materials, the results of which are shown in Table 10, below. As shown, the invention alloy realizes comparable corrosion resistance to that of conventional alloy A365, realizing similar types of attack.

TABLE 10

Depth of Attack in 24 Hour ASTM G110

| Location | Alloy | Depth of attack (Microns) site 1 | site 2 | site3 | site4 | site5 | Max. | Ave. | Type of Attack |
|---|---|---|---|---|---|---|---|---|---|
| Base | 6082-T6 | 27 | 4 | 4 | 4 | 4 | 27 | 8.6 | Pitting |
| Base | Invention-T6 | 323 | 254 | 246 | 244 | 242 | 323 | 261.8 | pitting + inter-dendritic |
| Base | A365-T6 | 191 | 189 | 187 | 164 | 164 | 191 | 179.2 | pitting + inter-dendritic |
| Invention-6082 weld | Invention-T6 near weld | 166 | 158 | 106 | 83 | 83 | 166 | 123.0 | Pitting + inter-dendritic |
| | 6082-T6 near weld | 19 | 19 | 19 | 14 | 14 | 19 | 17.4 | pitting |
| A365-6082 weld | A365-T6 near weld | 220 | 141 | 133 | 126 | 118 | 220 | 147.6 | Pitting + inter-dendritic |
| | 6082-T6 near weld | 24 | 17 | 12 | 9 | 8 | 24 | 14.0 | pitting |

Fatigue specimens were machined from an invention alloy cast node, and staircase fatigue testing in accordance with ASTM E466-15 was completed. Conventional alloy A365, also in the T6 temper, was also tested. Axial fatigue specimens were machined from HPDC brackets with wall thickness around 3 mm. Testing was conducted at room temperature in load control on servo-hydraulic test equipment employing a sinusoidal waveform operating at a test frequency 50 hertz. An R-Ratio of −1 was used with a run-out of 10,000,000 cycles. Any test reaching 10,000,000 cycles was discontinued.

The general test procedure is as follows: If a test reaches the desired cycle count, the next test is started at a higher stress level. If a test does not reach the desired cycle count, the next test is started at a lower stress level. This continues until the required number of tests is complete. The stress level adjustment is constant and is referred to as the step size.

The fatigue strength results are shown in FIG. 5 and Table 11, below. As shown, the invention alloy realizes significantly better fatigue life than the comparison alloy, approximately 21.4% better ((116.25−95.75)/95.75)=21.4%) in the case of the invention alloy cast node.

TABLE 11

Fatigue Strength Results

| | Invention Alloy Cast Node | | A365-T6 Cast Node | |
|---|---|---|---|---|
| Specimen # | Stress, MPa | Cycles to Failure | Stress, MPa | Cycles to Failure |
| 1 | 90 | 10,000,000 | 90.0 | 10,000,000 |
| 2 | 95 | 10,000,000 | 95.0 | 376,441 |
| 3 | 100 | 8,301,498 | 90.0 | 10,000,000 |
| 4 | 95 | 10,000,000 | 95.0 | 704,513 |
| 5 | 100 | 10,000,000 | 90.0 | 10,000,000 |
| 6 | 105 | 10,000,000 | 95.0 | 1,108,396 |
| 7 | 110 | 10,000,000 | 92.5 | 330,998 |
| 8 | 115 | 10,000,000 | 90.0 | 10,000,000 |
| 9 | 120 | 2,382,300 | 92.5 | 10,000,000 |
| 10 | 115 | 10,000,000 | 95.0 | 10,000,000 |
| 11 | 120 | 674,721 | 97.5 | 1,476,699 |
| 12 | 115 | 1,600,767 | 95.0 | 10,000,000 |
| 13 | 110 | 10,000,000 | 97.5 | 10,000,000 |
| 14 | 115 | 10,000,000 | 100.0 | 3,912,394 |
| 15 | 120 | 7,324,559 | 97.5 | 10,000,000 |
| 16 | 115 | 10,000,000 | 100.0 | 560,092 |
| 17 | 120 | 544,491 | 97.5 | 593,273 |
| 18 | 115 | 10,000,000 | 95.0 | 10,000,000 |
| 19 | 120 | 10,000,000 | 97.5 | 10,000,000 |
| 20 | 125 | 10,000,000 | 100.0 | 510,622 |
| 21 | 130 | 1,364,893 | 97.5 | 1,074,440 |
| 22 | 125 | 182,926 | 95.0 | 10,000,000 |

While various embodiments of the new technology described herein have been described in detail, it is apparent that modifications and adaptations of those embodiments will occur to those skilled in the art. However, it is to be expressly understood that such modifications and adaptations are within the spirit and scope of the presently disclosed technology.

What is claimed is:

1. A 3xx aluminum alloy shape cast product, consisting of:

6.5-8.9 wt. % Si;
0.55-0.80 wt. % Mg;
0.15-0.35 wt. % Cu;
0.30-0.80 wt. % Mn;
0.012-0.040 wt. % Sr;
up to 0.25 wt. % Ti;
up to 0.12 wt. % Fe; and
up to 0.20 wt. % Zn;
the balance being aluminum (Al) and impurities, wherein the 3xx aluminum alloy shape cast product includes not greater than 0.10 wt. % of any one impurity, and wherein the 3xx aluminum alloy shape cast product includes not greater than 0.35 wt. %, in total, of the impurities;
wherein the 3xx aluminum alloy shape cast ptoduct realizes a quality index of at least 400;
wherein the 3xx aluminum alloy shape cast product is absent of die soldering defects; and
wherein the 3xx aluminum alloy shape cast product includes a suffocoent amount of the Si, Mg, Cu, Mn, Sr, Ti, Fe, Zn, Al, and impurities to achieve a tensile yield strenght of at least 290 MPa and when tested in accordance with ASTM E8 and B557.

2. The 3xx aluminum alloy shape cast product of claim 1, having at least 7.25 wt. % Si.

3. The 3xx aluminum alloy shape cast product of claim 1, having at least 8.0 wt. % Si.

4. The 3xx aluminum alloy shape cast product of claim 1, having not greater than 0.75 wt. % Mg.

5. The 3xx aluminum alloy cast product of claim 1, having not greater than 0.70 wt. % Mg.

6. The 3xx aluminum alloy shape cast product of claim 1, having at least 0.18 wt. % Cu.

7. The 3xx aluminum alloy shape cast product of claim 1, having at least 0.35 wt. % Mn.

8. The 3xx aluminum alloy shape cast product of claim 1, having not greater than 0.65 wt. % Mn.

9. The 3xx aluminum alloy shape cast product of claim 1, having from 0.005 to 0.25 wt. % Ti.

10. The 3xx aluminum alloy shape cast product of claim 1, having not greater than 0.11 wt. % Fe and not greater than 0.15 wt. % Zn.

11. The 3xx aluminum alloy shape cast product of claim 1, wherein the 3xx aluminum alloy shape cast product includes a sufficient amount of the Si, Mg, Cu, Mn, Sr, Ti, Fe, Zn, Al, and impurities to achieve an elongation of at least 5% when tested in accordance with ASTM E8 and B557.

12. The 3xx aluminum alloy shape cast product of claim 1, wherein the 3xx aluminum alloy shape cast product includes a sufficient amount of the Si, Mg, Cu, Mn, Sr, Ti, Fe, Zn, Al, and impurities to achieve a quality index of at least 430.

13. The 3xx aluminum alloy shape cast product of claim 1, having at least 0.60 wt. % Mg.

14. The 3xx aluminum alloy shape cast product of claim 1, having at least 0.40 wt. % Mn.

15. The 3xx aluminum alloy shape cast product of claim 1, having at least 0.45 wt. % Mn.

16. The 3xx aluminum alloy shape cast product of claim 1, wherein the 3xx aluminum alloy shape cast product includes a sufficient amount of the Si, Mg, Cu, Mn, Sr, Ti, Fe, Zn, Al, and impurities to achieve an elongation of at least 6% when tested in accordance with ASTM E8 and B557.

17. The 3xx aluminum alloy shape cast product of claim 1, wherein the 3xx aluminum alloy shape cast product is an automotive component.

18. The 3xx aluminum alloy shape cast product of claim 17, wherein the shape cast product is a shape cast body-in-white part or a shape cast suspension part.

19. The 3xx aluminum alloy shape cast product of claim 1, wherein the 3xx aluminum alloy shape cast product has a wall thickness of from 2 to 5 mm.

20. The 3xx aluminum alloy shape cast product of claim 1, wherein the 3xx aluminum alloy shape cast product comprises a sufficient amount of alloying elements of Si, Mg, Cu, Mn, Sr, Ti, Fe, Zn, Al, and impurities to achieve an intergranular corrosion resistance that is comparable to the intergranular corrosion resistance of a baseline shaped cast part, wherein the baseline shaped cast part is made from conventional alloy A365, and wherein the intergranular corrosion resistance is tested in accordance with ASTM G110-92 (2015), measured on the as-cast shape cast part (not machined) after 24 hours of exposure.

* * * * *